US006834471B2

(12) United States Patent
Takagi et al.

(10) Patent No.: US 6,834,471 B2
(45) Date of Patent: Dec. 28, 2004

(54) EXTRUDED BRACKET WITH MITER CUT

(75) Inventors: Kyozaburo Takagi, Centerville, OH (US); Gordon Charles Dodson, Lewis Center, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

(21) Appl. No.: 10/224,295

(22) Filed: Aug. 20, 2002

(65) Prior Publication Data

US 2004/0035083 A1 Feb. 26, 2004

(51) Int. Cl.[7] ..... E04G 17/00; E04G 11/00

(52) U.S. Cl. ..... 52/699; 52/127.1; 52/730.1; 249/3; 249/219.1; 248/351

(58) Field of Search ..... 52/699, 127.2, 52/127.1, 656.5, 656, 730.4, 734, 730.1, 732, 720.1; 249/219.1, 194, 2, 3, 4, 5, 6, 7; 248/188.91, 519, 351, 247; 403/401

(56) References Cited

U.S. PATENT DOCUMENTS

| | | | | | |
|---|---|---|---|---|---|
| 870,045 | A | * | 11/1907 | Pruett et al. | 249/148 |
| 1,477,767 | A | * | 12/1923 | Pulis | 249/7 |
| 2,917,803 | A | * | 12/1959 | Phillips | 249/6 |
| 4,104,356 | A | | 8/1978 | Deutsch et al. | |
| 4,393,568 | A | * | 7/1983 | Navarro | 29/432 |
| 4,441,685 | A | * | 4/1984 | Greeson | 249/51 |
| 4,872,634 | A | | 10/1989 | Gillaspy et al. | |
| 5,088,255 | A | * | 2/1992 | Emanuel | 52/395 |
| 5,616,271 | A | * | 4/1997 | Podgurski | 249/48 |
| 5,771,640 | A | * | 6/1998 | Back | 52/90.1 |
| 6,230,451 | B1 | * | 5/2001 | Stoller | 52/169.1 |
| 6,322,045 | B1 | * | 11/2001 | Andros | 249/188 |
| 6,502,802 | B2 | * | 1/2003 | Jorn et al. | 249/194 |
| 6,540,201 | B1 | * | 4/2003 | Gagnon et al. | 249/139 |
| 2002/0062603 | A1 | * | 5/2002 | Shaw et al. | 52/125.1 |

* cited by examiner

*Primary Examiner*—Brian E. Glessner
(74) *Attorney, Agent, or Firm*—Dinsmore & Shohl LLP

(57) ABSTRACT

Extruded brackets for use in pre-cast panel forming systems are provided. The brackets generally have first and second mounting faces, at least one support face, and miter cut edges defined by a first and second miter plane. The brackets may have more than one support face. Additionally, a pre-cast panel forming system is provided. The system generally has at least one pre-cast panel form and at least one bracket for attachment to the at least one panel form. It is emphasized that this abstract is provided to comply with the rules requiring an abstract which will allow a searcher or other reader to quickly ascertain the subject matter of the technical disclosure. It is submitted with the understanding that is will not be used to interpret or limit the scope or meaning of the claims.

17 Claims, 6 Drawing Sheets

EXTRUDED BRACKET WITH MITER CUT

BACKGROUND

The present invention relates generally to the formation of pre-cast panels, and more particularly to brackets for use in pre-cast panel forming systems.

Pre-cast construction of concrete wall panels for tilt-up and other types of construction is well known in the art. In the tilt-up approach, forms, also known as form liners, are placed on a flat casting surface in the shape and dimension of the desired panel and filled with concrete. When the concrete cures, the forms may be removed, and the panel tilted up into a preferred, typically vertical, orientation, where it can be joined to structural frames or other panels. The forms are generally secured to the casting surface with brackets prior to the pouring of the concrete.

The present inventor has recognized a need for a bracket that may be used with a variety of pre-cast systems, including tilt-up panel forming systems. An additional need exists for such a bracket that can be easily attached, removed, and reused.

SUMMARY

This need is met by the present invention that provides brackets for use with pre-cast panel forming systems. As used herein, pre-cast panel forming systems include any panel forming system that allows panels to be formed from a cast material that upon curing hardens, thereby allowing the panel to be subsequently placed in a desired location within a building structure.

In accordance with one embodiment, a bracket for supporting a pre-cast panel form is provided. The bracket comprises first and second mounting faces and a first support face extending between the mounting faces. The first and second mounting faces meet to define a longitudinal vertex of the bracket. The first support face defines first and second lateral edges and first and second longitudinal edges and extends from each of the mounting faces along the longitudinal edges, and the longitudinal edges of the first support face are generally parallel to and displaced from the longitudinal vertex. The first and second mounting faces define top edges and first and second inwardly canted lateral edges. A first miter plane is defined by the first inwardly canted lateral edge of the first mounting face, the first inwardly canted lateral edge of the second mounting face, and the first lateral edge of the first support face. A second miter plane is defined by the second inwardly canted lateral edge of the first mounting face, the second inwardly canted lateral edge of the second mounting face, and the second lateral edge of the first support face. Generally, the first and second miter planes are orthogonal. The first longitudinal edge is typically displaced from the longitudinal vertex a distance equal to a distance the second longitudinal edge is displaced from the longitudinal vertex. The bracket is generally formed from extruded plastic.

The bracket typically has several nailing areas. The first mounting face may include at least one nailing area defined by the first and second inwardly canted lateral edges of the first mounting face, the top edge of the first mounting face, and the first longitudinal edge of the first support face. The second mounting faces may include at least one nailing area defined by the first and second inwardly canted lateral edges of the second mounting face, the top edge of the second mounting face, and the second longitudinal edge of the first support face. Additionally, the first mounting face may include at least one nailing area defined by the longitudinal vertex, the first longitudinal edge of the first support face, and portions of the first and second inwardly canted lateral edges of the first mounting face. The second mounting face may include at least one nailing area defined by the longitudinal vertex, the second longitudinal edge of the first support face, and portions of the first and second inwardly canted lateral edges of the second mounting face.

The bracket may also have at least one additional support face. A second support face may extend between the longitudinal vertex and the first support face. The second support face defines first and second lateral edges and first and second longitudinal edges and extends from the longitudinal vertex along the first longitudinal edge and the first support face along said second longitudinal edge. Typically, the first lateral edge of the second support face extends to the first miter plane, and the second lateral edge of the second support face extends to the second miter plane.

Alternatively, the bracket may have a second support face extending between the mounting faces. The second support face defines first and second lateral edges and first and second longitudinal edges and extends from each of the mounting faces along the longitudinal edges. The longitudinal edges of the second support face are generally parallel to and displaced from the longitudinal vertex. The first lateral edge extends to the first miter plane, and the second lateral edge extends to the second miter plane. The displacement of the second support face from the longitudinal vertex is a distance less than the displacement of the first support face from the longitudinal vertex. The bracket may also have a third support face extending between the longitudinal vertex and the second support face. The third support face defines first and second lateral edges and first and second longitudinal edges and extends from the longitudinal vertex along the first longitudinal edge and the second support face along the second longitudinal edge. The first lateral edge extends to the first miter plane, and the second lateral edge extends to the second miter plane. Alternatively, the third support face may extend between the first support face and the second support face. The third support face defines first and second lateral edges and first and second longitudinal edges and extends from the first support face the first longitudinal edge and the second support face along the second longitudinal edge. The first lateral edge extends to the first miter plane, and the second lateral edge extends to the second miter plane.

In another embodiment, the bracket may have a second support face extending between the first mounting face the first support face and a third support face extending between the second mounting face and the first support face. The second support face defines first and second lateral edges and first and second longitudinal edges and extends from the first mounting face along the first longitudinal edge and the first support face along the second longitudinal edge. The third support face defines first and second lateral edges and first and second longitudinal edges and extends from the second mounting face along the first longitudinal edge and the first support face along the second longitudinal edge. Typically, the first lateral edge of the second support face extends to the first miter plane, and the second lateral edge of the second support face extends to the second miter plane. Additionally, the first lateral edge of the third support face may extend the first miter plane and the second lateral edge the third support face may extend to the second miter plane.

In accordance with another embodiment, a pre-cast panel forming system is provided. The system comprises at least one pre-cast panel form having a height; and at least one bracket for attachment to the at least one panel form. The bracket comprises first and second mounting faces, and a first support face extending between the mounting faces. The first and second mounting faces meet to define a longitudinal vertex of the bracket. The first support face defines first and second lateral edges and first and second longitudinal edges and extends from each of the mounting faces along the longitudinal edges, and the longitudinal edges of the first support face are generally parallel to and displaced from the longitudinal vertex. Each of the first and second mounting faces define top edges and first and second inwardly canted lateral edges. A first miter plane is defined by the first inwardly canted lateral edge of the first mounting face, the first inwardly canted lateral edge of the second mounting face, and the first lateral edge of the first support face. A second miter plane is defined by the second inwardly canted lateral edge of the first mounting face, the second inwardly canted lateral edge of the second mounting face, and the second lateral edge of the first support face. The height of the first and second mounting face is less the height of the at least one pre-cast panel form.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

The present invention is directed toward a bracket for use with pre-cast panel forms. The bracket secures the forms to the casting slab prior to the formation of the pre-cast panel.

Figure 1:
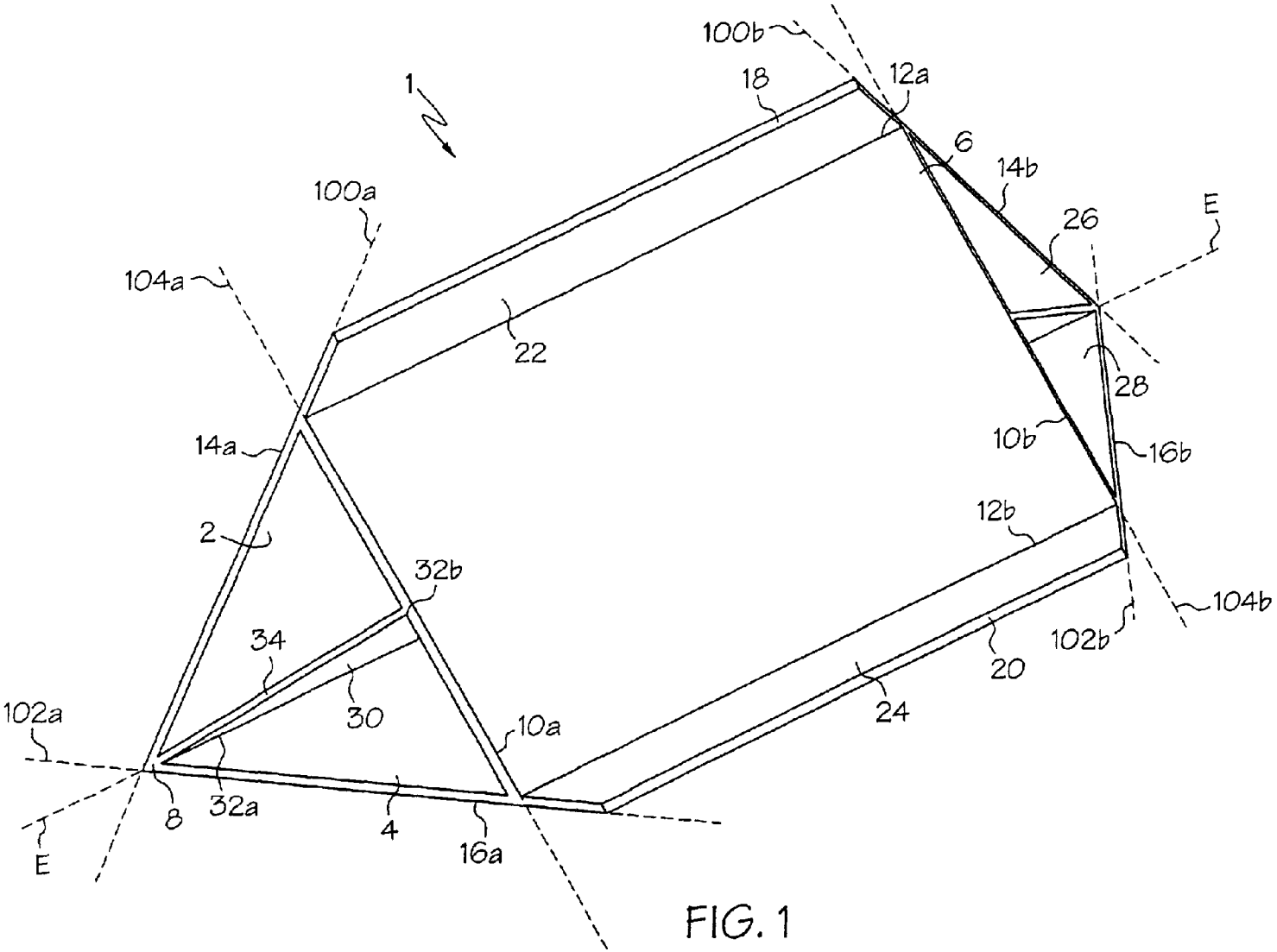
FIG. 1 is a three dimensional view of a bracket according to the present invention.
Figure 2:
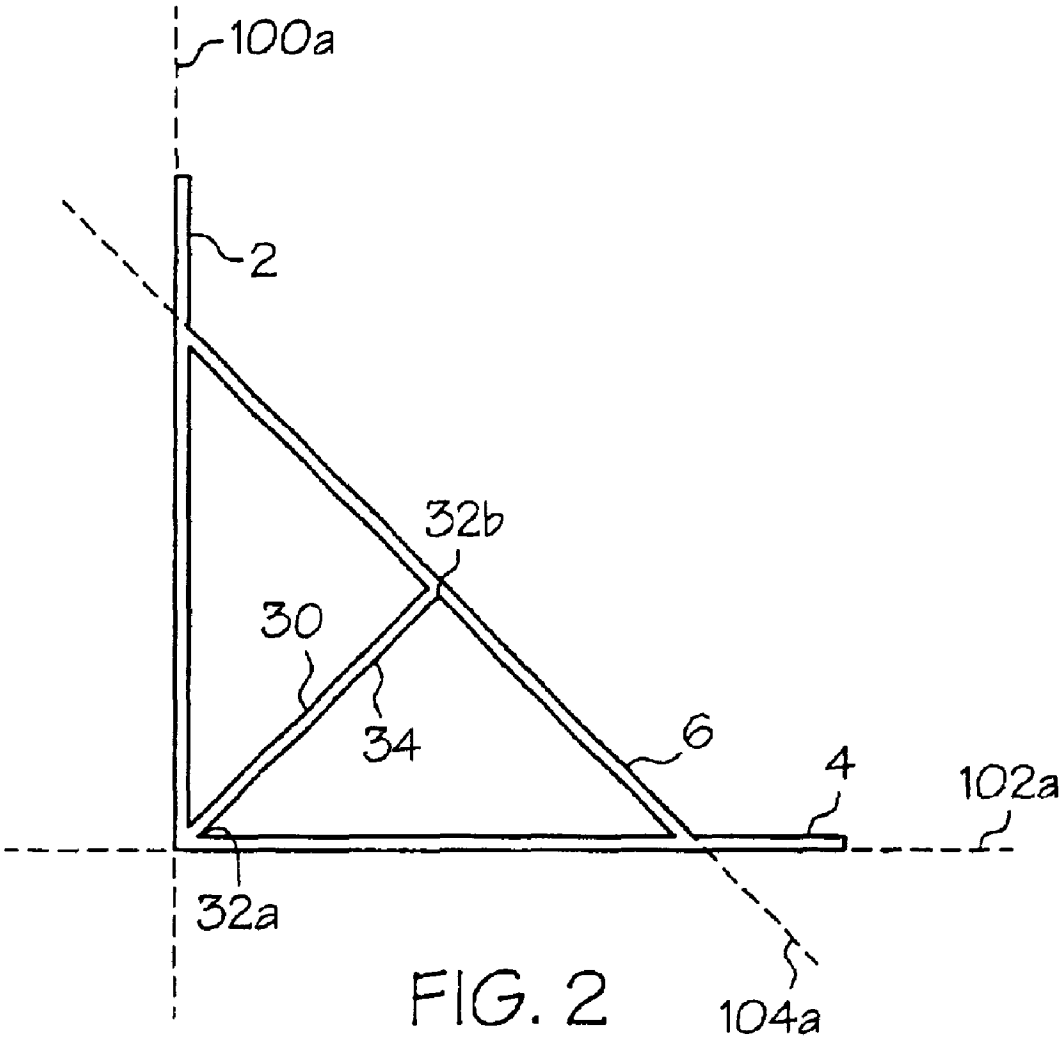
FIG. 2 is a side view of the bracket illustrated in FIG. 1.

Referring to FIGS. 1 and 2, a first embodiment of a bracket or support 1 is illustrated. The bracket 1 has a first mounting face 2, a second mounting face 4, and a first support face 6. The bracket 1 is typically formed from a plastic material (e.g., polyvinyl chloride (PVC), low or high-density polyethylene or polypropylene, acrylics, polycarbonates, thermoplastic elastomers). Generally, the bracket 1 is a one-piece bracket. The first mounting face 2 and the second mounting face 4 meet to define a longitudinal vertex 8 of the bracket. The first mounting face 2 and the second mounting face 4 are generally perpendicular to each other and form the mounting surface of the bracket. The first mounting face 2 has a top edge 18 and first and second inwardly canted lateral edges 14*a*, 14*b*. Therefore, the first mounting face 2 has a quadrilateral shape formed by the longitudinal vertex 8, the first and second inwardly canted lateral edges 14*a*, 14*b*, and the top edge 18. The inwardly canted lateral edges 14*a*, 14*b* slope inward from the longitudinal vertex 8 to the top edge 18. Therefore, an interior angle of less than 90° is formed between the first inwardly canted lateral edge 14*a* and the longitudinal vertex 8. Similarly, an interior angle of less than 90° is formed between the second inwardly canted lateral edge 14*b* and the longitudinal vertex. Generally the interior angles formed between the first and second inwardly canted lateral edges 14*a*, 14*b* and the longitudinal vertex 8 will be about 45°. Generally, the bracket 1 will be about four to eight inches wide (10.16 cm to 20.32 cm) from one end of the longitudinal vertex 8 to the other.

Similarly, the second mounting face has a top edge 20 and first and second inwardly canted lateral edges 16*a*, 16*b*. Therefore, the second mounting face 4 has a quadrilateral shape formed by the longitudinal vertex 8, the first and second inwardly canted lateral edges 16*a*, 16*b*, and the top edge 20. The inwardly canted lateral edges 16*a*, 16*b* slope inward from the longitudinal vertex 8 to the top edge 20. Therefore, an interior angle of less than 90° is formed between the first inwardly canted lateral edge 16*a* and the longitudinal vertex 8. Similarly, an interior angle of less than 90° is formed between the second inwardly canted lateral edge 16*b* and the longitudinal vertex 8. Generally the interior angles formed between the first and second inwardly canted lateral edges 16*a*, 16*b* and the longitudinal vertex 8 will be about 45°.

Referring to FIGS. 1 and 2, the bracket 1 also has a first support face 6 extending between the first mounting face 2 and the second mounting face 4. The first support face 6 has first and second lateral edges 10*a*, 10*b* and first and second longitudinal edges 12*a*, 12*b*. The first support face extends from the first mounting face 2 and the second mounting face 4 along the longitudinal edges 12*a*, 12*b*. The longitudinal edges 12*a*, 12*b* are generally parallel to the longitudinal vertex 8, and the longitudinal edges 12*a*, 12*b* are displaced from the longitudinal vertex 8. Typically, the first longitudinal edge 12*a* is displaced from the longitudinal vertex 8 by a distance equal to a distance the second longitudinal edge 12*b* is displaced from the longitudinal vertex 8.

The bracket 1 may be formed through a conventional extrusion process, and, as such define an extrudable cross-section. For the purposes of defining and describing the present invention, it is noted that a structural member defines an extrudable cross-sectional profile if respective cross sections of the member, taken along a length or width-wise axis of the member, each define substantially identical dimensions. In which case, the member defining the extrudable profile may be produced by an extrusion process where a semi-soft plastic is forced through the orifice of an extrusion die to produce a continuously formed piece having a cross-sectional shape defined by the orifice or other shaping members down line of the orifice. It is contemplated that a structural member having an extrudable cross-sectional profile may also include portions along its axis that are subject to post extrusion cutting, drilling, bending, deforming, etc.

Referring to FIG. 1, it is noted that the bracket 1 may be extruded along an extrusion axis E. Extrusion axis E lies along longitudinal vertex 8, and longitudinal vertex defines a longitudinal dimension of the bracket. Specifically, the bracket 1 may define an extrudable cross-sectional profile spaced along an extrusion axis E. Referring to FIGS. 1 and 2, it is noted that the end portions of the bracket 1 are provided with miter-cuts to form miter-cut edges that extend all the way across the extrudable cross-sectional profile. The cross-sectional profile of the bracket 1 has a shape that is generally that of a right triangle along a portion the longitudinal dimension defined between the miter cut edges of the end portions. The first support face 6 defines the hypotenuse of the right triangle while the first and second mounting faces 2, 4 define the other two sides. The hypotenuse of the right triangle may be recessed from the edges defined by the first and second mounting faces 2, 4.

A first and second miter plane may define the miter-cut edges. A first miter plane is shown in FIG. 1 as being defined by reference lines 100*a*, 102*a*, and 104*a*. Line 100*a* is defined along the first inwardly canted lateral edge 14*a* of the first mounting face. Line 102*a* is defined along the first inwardly canted lateral edge 16*a* of the second mounting face 4. Line 104*a* is defined along the first lateral edge 10*a* of the first support face 6, 2. A second miter plane is shown in FIG. 1 as being defined by reference lines 100*b*, 102*b*, and 104*b*. Line 100*b* is defined along the second inwardly canted lateral edge 14*b* of the first mounting face 2. Line 102*b* is defined along the second inwardly canted lateral edge 14*b* of the first mounting face 2. Line 104*b* is defined along the second lateral edge 10*b* of the first support face 6. The first miter plane and the second miter plane may be orthogonal to each other or may be oriented to define any other suitable angle of intersection.

Figure 3:
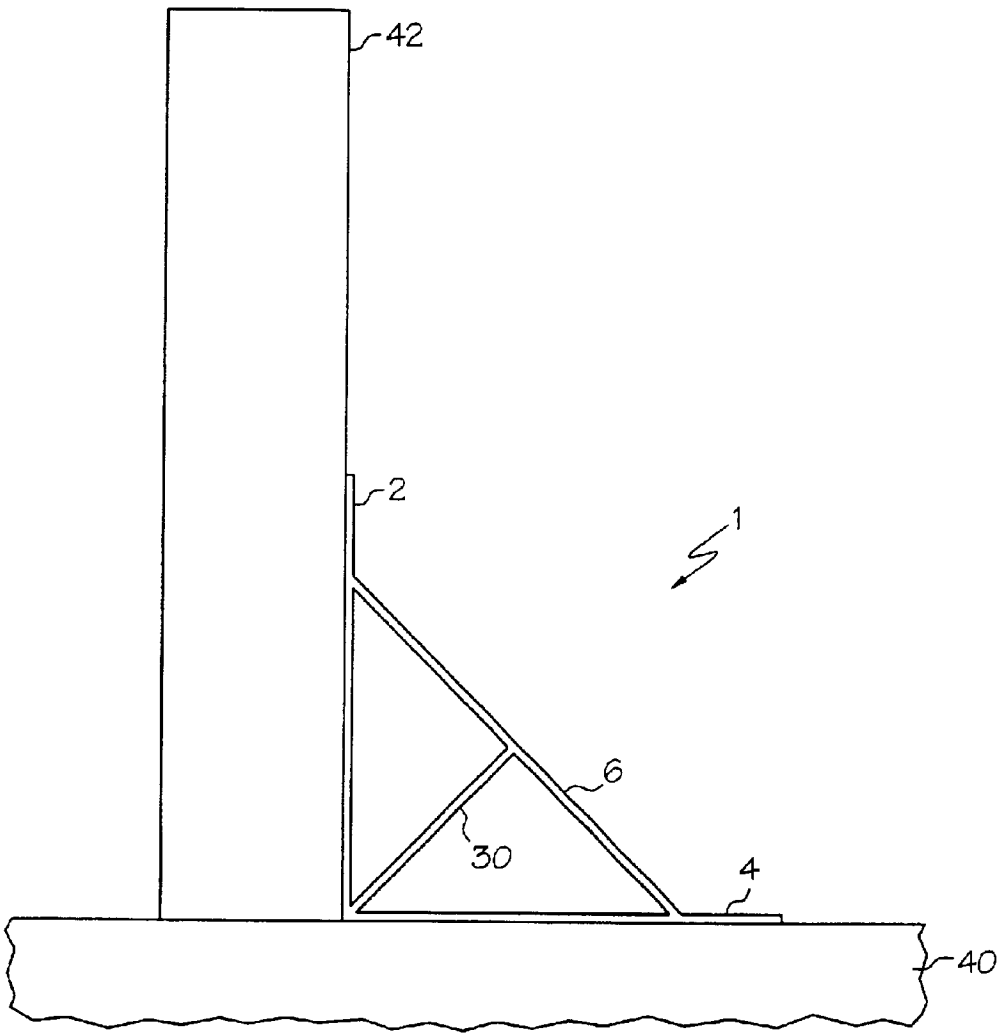
FIG. 3 is an illustration of an assembled configuration utilizing a bracket and a pre-cast form according to the present invention.

Referring to FIGS. 1, 2, and 3, the bracket 1 typically includes several nailing areas through which nails or other fasteners may be driven to attach the bracket 1 to the pre-cast form 42 and the panel forming slab 40. The bracket typically has nailing areas 22 and 24 that are located near the top edges 18, 20 of the first and second mounting faces 2, 4. Nailing area 22 is defined by the first and second inwardly canted lateral edges 14*a*, 14*b* of the first mounting face 2, the top edge 18 of the first mounting face 2, and the first longitudinal edge 12*a* of the first support face 6. Typically, the distance between the first longitudinal edge 12*a* of the first support face 6 and the top edge 18 of the first mounting face 2 will be about ⅝ to ¼ inch (1.60 cm to 0.64 cm). Similarly, nailing area 24 is defined by the first and second inwardly canted lateral edges 16*a*, 16*b* of the second mounting face 4, the top edge 20 of the second mounting face 4, and the second longitudinal edge 12*b* of the first support face 6. The distance between the second longitudinal edge 12*b* of the first support face 6 and the top edge 18 of the second mounting face 4 will generally be about ⅝–¼ inch.

The bracket additionally has nailing areas 26 and 28 that are located near the inwardly canted lateral edges 14*a*, 14*b*, 16*a*, 16*b* of the first and second mounting faces 2, 4. Nailing area 26 is defined by the longitudinal vertex 8, the first longitudinal edge 12*a* of the first support face 6, and portions of the first and second inwardly canted lateral edges 14*a*, 14*b* of the first mounting face 2. Nailing area 28 is defined by the longitudinal vertex, the second longitudinal edge 12*b* of the first support face 6, and portions of the first and second inwardly canted lateral edges 16*a*, 16*b* of the second mounting face 4. Nailing areas 26 and 28 are located on the first and second mounting faces 2, 4 in the areas below the first and second miter planes 100*a*, 100*b*. Nailing areas 26 and 28 are easily accessible for nailing during installation of the brackets because they are exposed beneath the first and second miter planes.

Referring to FIGS. 1 and 3, the bracket 1 is used to attach the pre-cast panel form 42 to the casting surface 40 in an upright configuration. The pre-cast panel form 42 is generally made from dimensional lumber or other wooden products. The pre-cast panel form 42 may also be made from a variety of plastic materials such as an extruded plastic. The pre-cast panel form 42 is placed on the casting slab 40 and bracket 1 is attached to the pre-cast panel form 42 and the casting slab 40 to hold the form 42 in place prior to the formation of a pre-cast panel. The first mounting face 2 of the bracket 1 is attached to the form 42, and the second mounting face 4 is attached to the casting slab 40. However, the second mounting face 4 could be attached to the form 42, and the first mounting face 2 could be attached to the casting slab 40. By attaching the form 42 to the slab 40 with the bracket 1, the form 42 may be oriented securely perpendicular to the casting slab 40 or may be oriented to define any other suitable angle. The height of the first and second mounting faces 2, 4 is generally less than the height of the pre-cast panel form 42. Typically, the first and second mounting faces will be about six inches tall. Several forms 42 and brackets 1 are generally used to form a pre-cast panel. The bracket 1 is attached to the slab 40 and the form 42 by utilizing fasteners such as nails. The fasteners are typically placed through nailing areas 22, 24, 26, and 28. However, not all of the nailing areas must be utilized. After the formation of the panel, the pre-cast form 42 and the bracket 1 are removed. The bracket 1 may be reused during the formation of another pre-cast panel.

Referring to FIGS. 1–7, the bracket 1 may have at least one additional support face. The additional support faces add structural stability to the bracket 1 and allow the bracket to resist twisting and bending when subjected to stress. In one embodiment shown in FIGS. 1–3, a second support face 30 extends between the longitudinal vertex 8 and the first support face 6. The second support face has lateral edges 30 and first and second longitudinal edges 32*a*, 32*b*. The second support face 30 extends from the longitudinal vertex 8 along first longitudinal edge 32*a* to the first support face 6 along said second longitudinal edge 32*b*. Generally, the lateral edges 30 extend to the first and second miter planes respectively.

Figure 4:
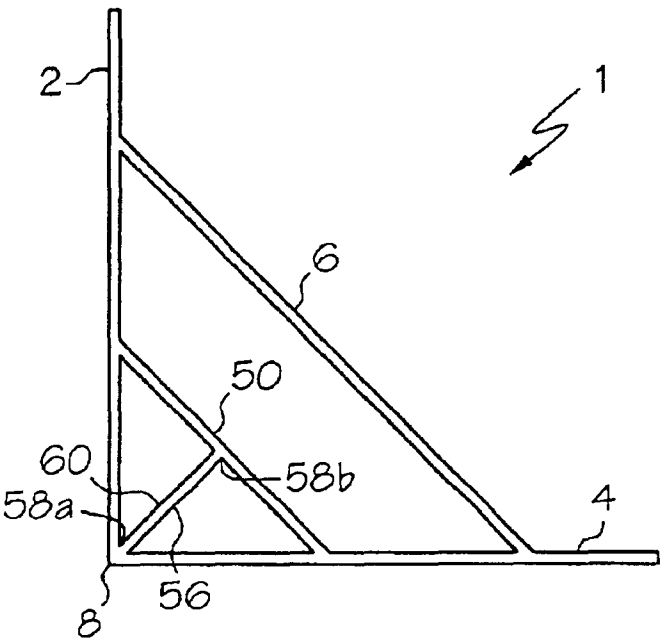
FIGS. 4–7 illustrates additional embodiments of a bracket according to the present invention.
Figure 8:
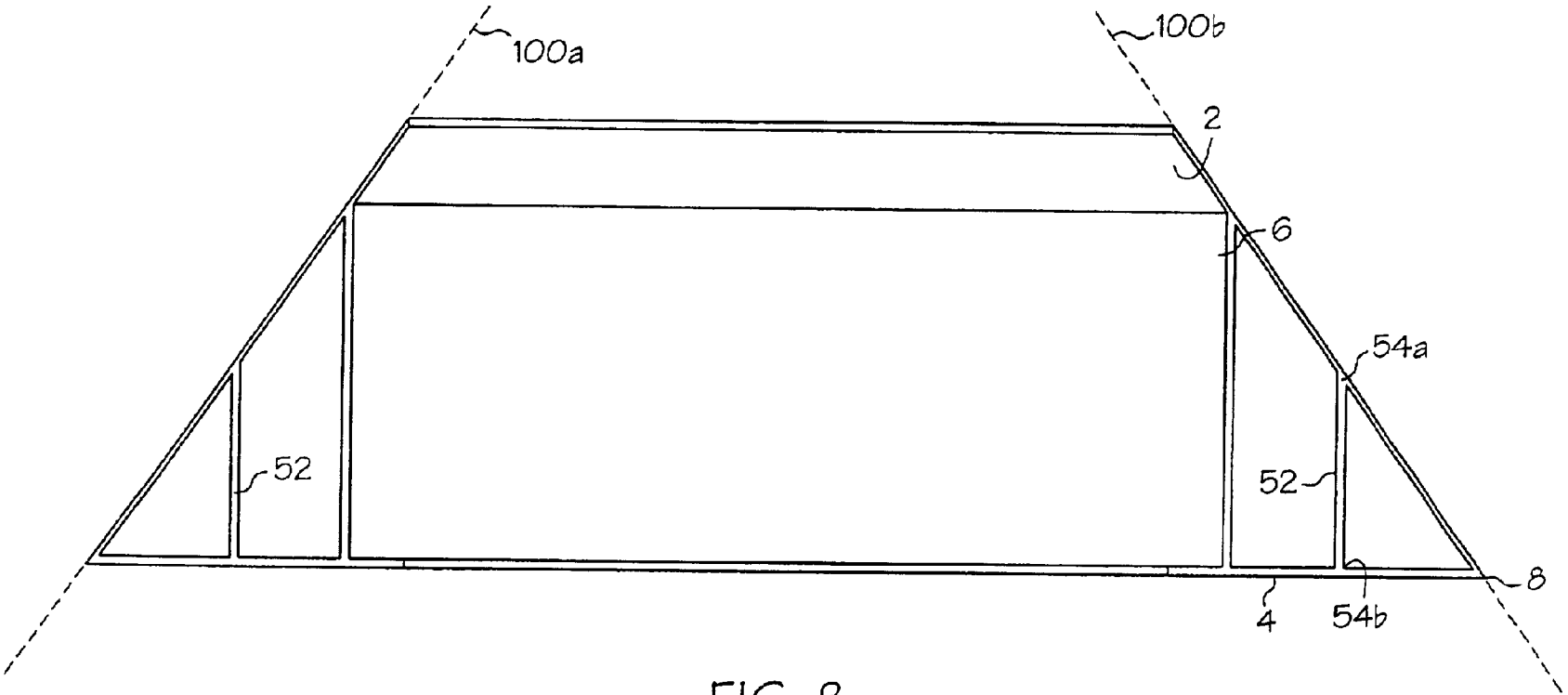
FIG. 8 is a front view of the bracket illustrated in FIG. 4.

Referring to FIGS. 4 and 8, the bracket 1 may alternatively have a second support face 50 extending between the first mounting face 2 and the second mounting face 4. The second support face 50 has lateral edges 52 and first and second longitudinal edges 54*a*, 54*b*. The first and second longitudinal edges 54*a*, 54*b* are generally parallel to and displaced from the longitudinal vertex 8. The displacement of the second support face 50 from the longitudinal vertex 8 is less than the displacement of the first support face 6 from the longitudinal vertex 8. The lateral edges 52 generally extend to the first and second miter planes respectively.

Figure 5:
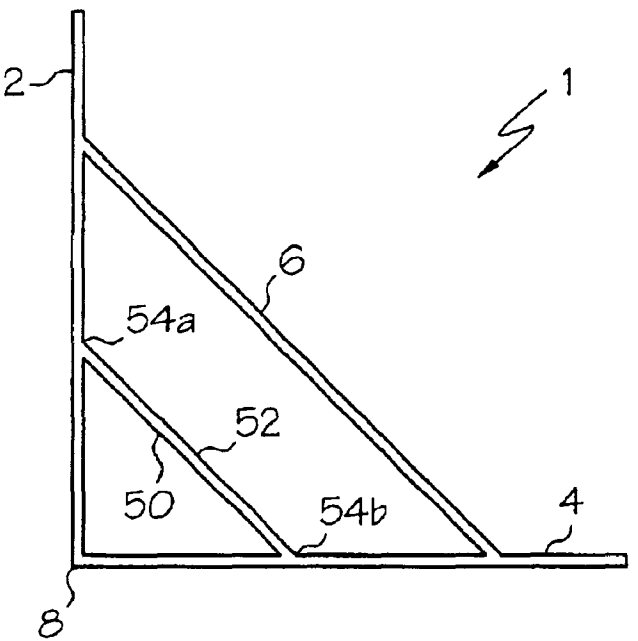

Referring to FIG. 5, the bracket 1 may additionally have a third support face 56 extending between the longitudinal vertex 8 and the second support face 50. The third support face 56 has a first longitudinal edge 58*a*, *a* second longitudinal edge 58*b*, and lateral edges 60. The third support face 56 extends from the longitudinal vertex 8 the first longitudinal edge 58*a*, and the third support face 56 extends from the second support face along the second longitudinal edge 58*b*. The lateral edges 60 generally extend to the first and second miter planes respectively.

Figure 6:
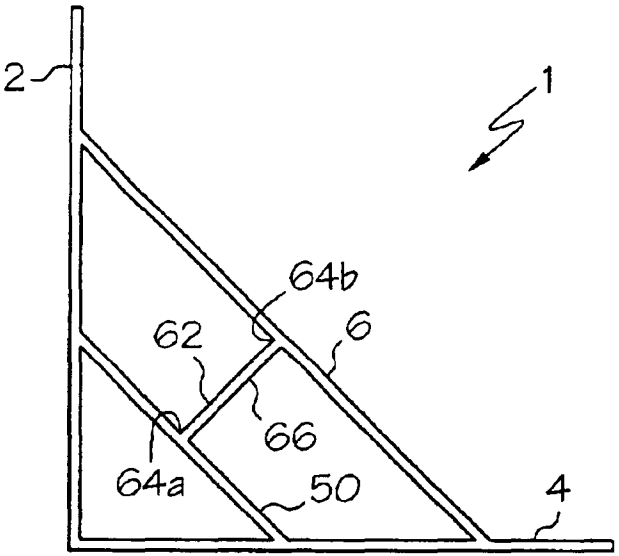

Referring to FIG. 6, the bracket 1 may alternatively have a third support face 62 extending between the second support face 50 and the first support face 6. The third support face 62 has first and second longitudinal edges 64*a*, 64*b* and lateral edges 66. The third support face 62 extends from the second support face 50 along the first longitudinal edge 64*a*. The third support face 62 extends from the first support face 6 along the second longitudinal edge 64*b*. The lateral edges 66 extend to the first and second miter planes respectively.

Figure 7:
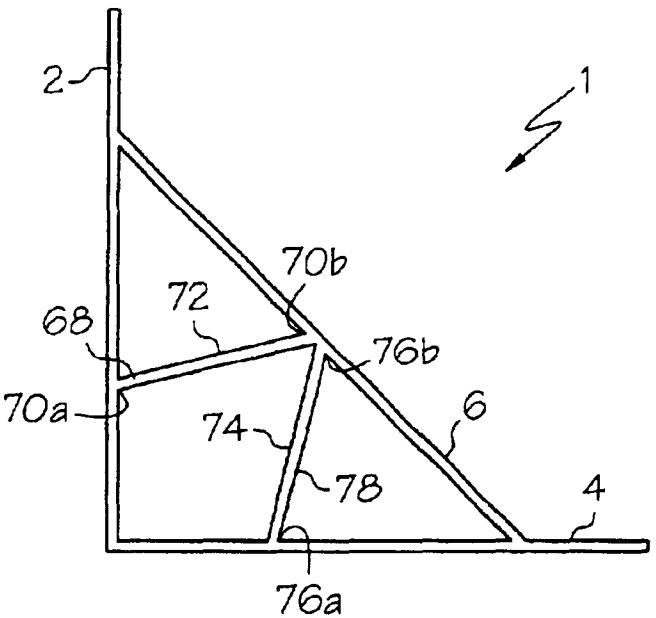

Referring to FIG. 7, a bracket 1 with alternative second 68 and third 74 support faces is shown. The second support face 68 has lateral edges 72 and first and second longitudinal edges 70*a*, 70*b*. The second support face 68 extends between the first mounting face 2 and the first support face 6. The second support face 68 extends from the first mounting face 2 along the first longitudinal edge 70*a*. The second support face 68 extends from the first support face 6 along the second longitudinal edge 70*b*. The second support face 68 is shown as having an interior angle of less than 90° with respect to the first mounting face 2. However, this angle may be adjusted to be greater than, less than, or equal to 90°. The third support face 74 extends between the second mounting face 4 and the first support face 6. The third support face 74 has first and second longitudinal edges 76*a*, 76*b* and lateral edges 78. The third support face 74 extends from the second mounting face 4 along the first longitudinal edge 76*a*, and the third support face 74 extends from the first support face 6 along the second longitudinal edge 76*b*. The third support face 74 is shown as having an interior angle of less than 90° with respect to the second mounting face 4. However, this angle may be greater than, less than, or equal to 90°. The lateral edges 72 of the second support face 68 and the lateral edges 78 of the third support face 74 generally extend to the first and second miter planes respectively.

It will be obvious to those skilled in the art that various changes may be made without departing from the scope of the invention, which is not to be considered limited to what is described in the specification.

What is claimed is:

1. A pre-cast panel forming system comprising:

at least one pre-cast panel form having a height; and at least one bracket for supporting said at least one panel form, wherein:

said bracket comprises first and second mounting faces and a first support face extending between said mounting faces;

said first and second mounting faces meet to define a longitudinal vertex of said bracket;

said first support face defines first and second lateral edges and first and second longitudinal edges and extends from each of said mounting faces along said longitudinal edges;

said longitudinal edges of said first support face are generally parallel to and displaced from said longitudinal vertex;

each of said first and second mounting faces define top edges and first and second inwardly canted lateral edges;

a first miter plane is defined by said first inwardly canted lateral edge of said first mounting face, said first inwardly canted lateral edge of said second mounting face, and said first lateral edge of said first support face;

a second miter plane is defined by said second inwardly canted lateral edge of said first mounting face, said second inwardly canted lateral edge of said second mounting face, and said second lateral edge of said first support face; and the height of said first and second mounting face is less than said height of said at least one pre-cast panel form.

2. A pre-cast panel forming system, comprising:

at least one pre-cast panel form; and at least one bracket for supporting said at least one pre-cast panel form, wherein:

said bracket comprises first and second mounting faces and a first support face extending between said mounting faces;

said first and second mounting faces meet to define a longitudinal vertex of said bracket;

said first support face defines first and second lateral edges and first and second longitudinal edges and extends from each of said mounting faces along said longitudinal edges;

said longitudinal edges of said first support face are generally parallel to and displaced from said longitudinal vertex;

each of said first and second mounting faces define top edges and first and second inwardly canted lateral edges;

a first miter plane is defined by said first inwardly canted lateral edge of said first mounting face, said first inwardly canted lateral edge of said second mounting face, and said first lateral edge of said first support face; and a second miter plane is defined by said second inwardly canted lateral edge of said first mounting face, said second inwardly canted lateral edge of said second mounting face, and said second lateral edge of said first support face.

3. The system as claimed in claim 2 wherein said first and second miter planes are orthogonal.

4. The system as claimed in claim 2 wherein said first longitudinal edge is displaced from said longitudinal vertex a distance equal to a distance, said second longitudinal edge is displaced from said longitudinal vertex.

5. The system as claimed in claim 2 wherein said bracket is formed from extruded plastic.

6. The system a claimed in claim 2 wherein said first mounting face includes at least one nailing area defined by said first and second inwardly canted lateral edges of said first mounting face, said top edge of said first mounting face, and said first longitudinal edge of said first support face.

7. The system as claimed in claim 2 wherein said second mounting face includes at least one nailing area defined by said first and second inwardly canted lateral edges of said second mounting face, said top edge of said second mounting face, and said second longitudinal edge of said first support face.

8. The system as claimed in claim 2 wherein said first mounting face includes at least one nailing area defined by said longitudinal vertex, said first longitudinal edge of said first support face, and portions of said first and second inwardly canted lateral edges of said first mounting face.

9. The system as claimed in claim 2 wherein said second mounting face includes at least one nailing area defined by said longitudinal vertex, said second longitudinal edge of said first support face, and portions of said first and second inwardly canted lateral edges of said second mounting face.

10. The system as claimed in claim 2 wherein said at least one bracket further comprises a second support race extending between said longitudinal vertex and said first support face, wherein said second support face defines first and second lateral edges and first and second longitudinal edges and extends from said longitudinal vertex along said first longitudinal edge and said first support face along said second longitudinal edge.

11. The system as claimed in claim 10 wherein said first lateral edge of said second support face extends to said first miter plane and said second lateral edge of said second support face extends to said second miter plane.

12. The system as claimed in claim 2 wherein said at least one bracket further comprises a second support face extending between said mounting faces, wherein:

said second support face defines first and second lateral edges and first and second longitudinal edges and extends from each of said mounting faces along said longitudinal edges;

said longitudinal edges of said second support face are generally parallel to and displaced from said longitudinal vertex;

said first lateral edge extends to said first miter plane and said second lateral edge extends to said second miter plane; and said displacement of said second support face from said longitudinal vertex is a distance less than said displacement of said first support face from said longitudinal vertex.

13. The system as claimed in claim 12 wherein said at least one bracket further comprises a third support face extending between said longitudinal vertex and said second support face, wherein:

said third support face defines first and second lateral edges and first and second longitudinal edges and extends from said longitudinal vertex along said first longitudinal edge and said second support face along said second longitudinal edge; and said first lateral edge extends to said first miter plane and said second lateral edge extends to said second miter plane.

14. The system as claimed in claim 12 wherein said at least one bracket further comprises a third support face extending between said first support face and said second support face, wherein:

said third support face defines first and second lateral edges and first and second longitudinal edges and extends from said first support face along said first longitudinal edge and said second support face along said second longitudinal edge; and said first lateral edge extends to said first miter plane and said second lateral edge extends to said second miter plane.

15. The system as claimed in claim 2 wherein said at least one bracket further comprises a second support face extending between said first mounting face and said first support face and a third support face extending between said second mounting face and said first support face, wherein:

said second support face defines first and second lateral edges and first and second longitudinal edges and extends from said first mounting face along said first longitudinal edge and said first support face along said second longitudinal edge; and said third support face defines first and second lateral edges and first and second longitudinal edges and extends from said second mounting face along said first longitudinal edge and said first support face along said second longitudinal edge.

16. The system as claimed in claim 15 wherein said first lateral edge of said second support face extends to said first miter plane and said second lateral edge of said second support face extends to said second miter plane, and wherein said first lateral edge of said third support face extends to said first miter plane and said second lateral edge of said third support face extends to said second miter plane.

17. A pre-cast panel forming system, comprising:

at least one pre-cast panel form; and at least one support for supporting said at least one pre-cast panel form, wherein:

said support is formed of an extrudable plastic material;

said support defines a longitudinal dimension extending between respective end portions of said support;

said support defines an extrudable cross-sectional profile along said longitudinal dimension;

each of said end portions of said support is defined by a miter-cut edge extending completely across said extrudable cross-sectional profile; and said extrudable cross-sectional profile defines a generally right triangle shape along a portion of said longitudinal dimension defined between said miter-cut edges of said end portions.

* * * * *

UNITED STATES PATENT AND TRADEMARK OFFICE

CERTIFICATE OF CORRECTION

PATENT NO. : 6,834,471 B2
DATED : December 28, 2004
INVENTOR(S) : Takagi et al.

It is certified that error appears in the above-identified patent and that said Letters Patent is hereby corrected as shown below:

Column 8,
Line 24, "distance," should read -- distance --
Line 28, "a" should read -- as --

Signed and Sealed this

Thirty-first Day of May, 2005

JON W. DUDAS
*Director of the United States Patent and Trademark Office*